US006956485B1

(12) United States Patent
Aird et al.

(10) Patent No.: US 6,956,485 B1
(45) Date of Patent: Oct. 18, 2005

(54) FIRE DETECTION ALGORITHM

(75) Inventors: Robert Frederick Aird, Surrey (GB); Edward Grellier Colby, Cambridge (GB); Michael John Black, Cambridge (GB)

(73) Assignee: VSD Limited, (GB)

( * ) Notice: Subject to any disclaimer, the term of this patent is extended or adjusted under 35 U.S.C. 154(b) by 0 days.

(21) Appl. No.: 10/089,203

(22) PCT Filed: Sep. 27, 2000

(86) PCT No.: PCT/GB00/03717

§ 371 (c)(1),
(2), (4) Date: Sep. 3, 2002

(87) PCT Pub. No.: WO01/24131

PCT Pub. Date: Apr. 5, 2001

(30) Foreign Application Priority Data

Sep. 27, 1999 (GB) ..... 9922761

(51) Int. Cl.[7] ..... G08B 17/12
(52) U.S. Cl. ..... 340/577; 340/578; 382/100
(58) Field of Search ..... 340/577, 287, 340/578, 587; 116/4, 5; 382/100

(56) References Cited

U.S. PATENT DOCUMENTS

| | | | | |
|---|---|---|---|---|
| 5,153,722 | A * | 10/1992 | Goedeke et al. | 348/159 |
| 5,510,772 | A * | 4/1996 | Lasenby | 340/578 |
| 5,937,077 | A * | 8/1999 | Chan et al. | 382/100 |
| 6,278,374 | B1 * | 8/2001 | Ganeshan | 340/578 |
| 6,373,393 | B1 * | 4/2002 | Matsukuma et al. | 340/578 |

FOREIGN PATENT DOCUMENTS

EP 0583131 2/1994

* cited by examiner

*Primary Examiner*—Jeffery Hofsass
*Assistant Examiner*—Eric Blount
(74) *Attorney, Agent, or Firm*—Ostrolenk, Faber, Gerb & Soffen, LLP

(57) ABSTRACT

A method and apparatus for the detection of flame by entering (S1) a video signal into an algorithm which processes individual pixels in (S2) a frequency band is determined and used as a filter (S3) applies a threshold to create a map of significant movement (S4) applies an awareness map (S5) a number of parameters are calculated to decide whether flame is present in the video images being processed (S6) applies further filtering before indicating an alarm registering the presence of a flame threat.

15 Claims, 1 Drawing Sheet

Key.

1. is camera, 2 is frame grabber, 3 is processor, 4 is alarm output, 5 is flame

Key.

1. is camera, 2 is frame grabber, 3 is processor, 4 is alarm output, 5 is flame

FIRE DETECTION ALGORITHM

FIELD OF THE INVENTION

The invention relates to the field of video processing and fire detection and specifically an algorithm is described that allows the detection of a flame from a digitised video data stream. A system for video flame detection is described.

BACKGROUND

The use of video camera and digital video processing techniques for determining and detecting features from the image are well known in the art. The inventors have previously disclosed in PCT Application GB99/03459 a system for detecting smoke in the image. These systems are used as another sensor input for a fire alarm system. Flame is a further component in combustion and it is possible to have a fire event that produces no smoke. An algorithm that detects the presence of flame within a video image provides a further input into the fire detection process.

SUMMARY OF THE INVENTION

According to the present invention there is provided an algorithm that extracts features from a video data stream and is able to detect the presence of flame within the video data stream.

According to a further aspect of the invention there is provided a system for providing an alarm indicating the presence of flame within a scene that is observed by a video camera.

BRIEF DESCRIPTION OF THE DRAWINGS

Embodiments of the invention will now be described, by way of example, with reference to the accompanying drawings, in which.

DETAILED DESCRIPTION

Figure 1:
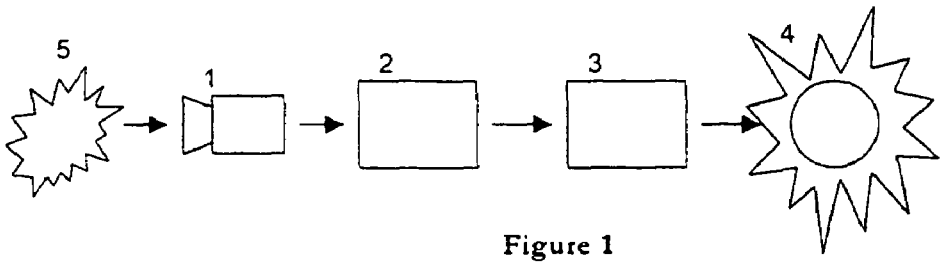
FIG. 1 shows the block diagram of the flame detection system.

The flame detection system shown in FIG. 1 comprises an analogue black and white video camera 1, which outputs a standard 625 line analogue video signal at a 25 Hz frame rate to a frame grabber card 2. Cameras are widely available and the inventors are using a standard VHS video camera from Hitachi. The frame grabber card digitizes the image to a resolution of 640 pixels per lime with 480 lines and passes the digitized image into the processor, 3, at the frame rate. The frame grabber card is a standard piece of hardware and a National Instruments PCI 1411 device plugged into the PCI bus of a standard PC is used. The processor 3, comprises a standard IMB™ PC using a 750 Hz Intel Pentium 3™ processor with 128Mbytes of RAM. The processor executes the algorithm, which is coded in a mixture of LabView™ and Microsoft™ Visual C++. The processor outputs an alarm signal, 4, by means of a standard serial RS232 link. This output may be used in a number of obvious ways to indicate a fire alarm event.

Figure 2:
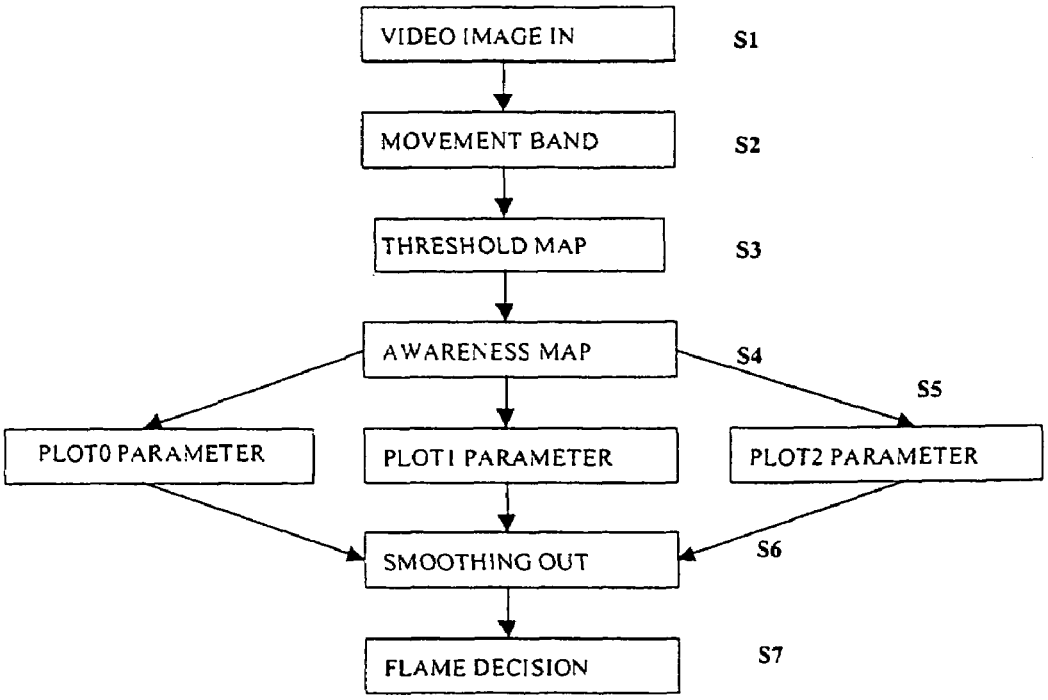
FIG. 2 shows the steps comprising the algorithm

The algorithm comprises a series of steps labelled S1 to S7 in the flow chart shown in FIG. 2. These steps are now described.

In step 1, the video image entered into the algorithm is in the form of a monochrome 640×480 image where each image pixel has an intensity value of 8 bits resolution. The algorithm processes each pixel individually, using linear mathematical operations.

In step 2, the monochrome 640×480 8 bit image is used to generate two separate averaged 640×480 8 bit resolution images which filter out rapidly occurring events, one with filter sets at 1.25 Hz and the other with a filter set at 4.0 Hz. The absolute difference between the pixel values of these two images is then taken to obtain a movement band 640×480 8 bit image, which displays entities that are moving in the image within the frequency band between 1.25 Hz and 4.0 Hz. This frequency band corresponds with the range of movement frequencies exhibited by petrol flames observed empirically by the inventors.

In the first averaged image, a dimensionless time constant k1, is used to generate a 640×480 resolution 8 bit image that filters out events that occur more rapidly than 4 Hz.

k1 is calculated using the following relationship:

$$k1=1/(4\ \text{Hz}\times\text{time in seconds between successive frames})$$

k1 is then used to generate an image that filters out events that occur at higher frequencies than 4 Hz in the following manner.

$$pM1=k1\times(\text{live pixel image value})+(1-k1)\times(\text{value of } pM1 \text{ from previous frame})$$

where pM1 is a rolling average with a starting value of zero. Each pixel in the 640×480 live image has a corresponding value of pM1 which can be used to make up the averaged image.

In the second averaged image, a dimenisonless time constant k2, is used to generate a 640×480 resolution 8 bit image that filters out events that occur more rapidly than 1.25 Hz.

k2 is calculated in the following relationship:

$$k2=1/(1.25\ \text{Hz}\times\text{time in seconds between successive frames})$$

k2 is then used to generate an image that filters out events that occur at higher frequencies than 1.25 Hz in the following manner.

$$pM2=k2\times(\text{live pixel image value})+(1-k2)\times(\text{value of } pM2 \text{ from previous frame})$$

where pN2 is a rolling average with a starting value of zero. Each pixel in the 640×480 image ha a corresponding value of pM2 which can be used to make up the averaged image.

Once the two 640×480 time filtered images with pixel values equal to pM1 and pM2 have been generated a so-called movement band 640×480 resolution image is generated by taking each of the pixels of these averaged images and calculating the absolute difference between pM1 and pM2 by finding the magnitude of the difference between each of the individual pixels obtained by subtracting pM1 from pM2. In this manner, a 640×480 image is obtained which only displays events that occur in the frequency band between 1.25 Hz and 4 Hz. Each pixel of the movement band image has an 8 bit resolution.

In step 3, once an image has been filtered using the movement band, the filtered image has a threshold applied to create a map of significant movement in the characteristic frequency band defined by k1 and k2. The study of the temporal dynamics of these highlighted pixels is used to decide whether or not flames are present in the video image. The best value for this threshold, based on the observation of outdoor petrol flames is equal to value of 5% of the dynamic range of values in the 640×480 8 bit movement band image, is r1=13, rounded up to the nearer whole number. In the application written in LabView™, the user of the system can set this value to an arbitrary value between 0 and 255 using the graphical user interface provided by LabView™. If a pixel value of the movement band image is greater than the threshold value, it is entered as 1 into the threshold map. If a pixel value of the movement band image is lower than the threshold value it is entered as 0 into the threshold map. The threshold map is a Boolean image of 640×480 pixels where non-threshold pixels have a value of zero, and thresholded pixels have a value of one.

In step 4, the "awareness map" is a subset of the "threshold map". In order to generate the awareness map, each pixel in the threshold map defined in step 3 has an awareness level, which is an indication of the likelihood of a flame existing within that particulate pixel. If the awareness level, increases above a user-defined threshold defined as the integer r2 (nominal value of 40), then the threshold pixel is registered with binary value 1, into the awareness map.

The "awareness map" is a 640×480 Boolean image. An integer defined as the awareness level is generated for each of the pixels in the "awareness map". The value of the awareness level is calculated by comparing successive frames of the "awareness map". When the program begins, the value of the awareness level for each of the pixels is equal to zero.

If a pixel in the awareness map changes from 1 to 0 or changes from 0 to 1 between successive video frames, then 2 is added to the value of the awareness level for that pixel. If a pixel in the awareness map does not change (i.e. stays at 0 or stays at 1) between successive frames, then 1 is subtracted from the awareness level. The minimum value of the awareness level is zero i.e. if the awareness level becomes negative it is immediately set to zero.

This means that flickering movements within the frequency band defined by k1 and k2 will cause a rapid increase in the awareness level for each individual pixel. These flickering movements have been observed by the inventors to be characteristic of flame.

In step 5, a number of parameters are calculated so that the algorithm can decide whether a flame is present in the video images that are being processed. These parameters may be plotted in a moving graph or used to determine a confidence of a flame detection event. The Plot0 parameter is a constant equal to an integer called the Alarm Level, user defined with a default value of 20. A flame is registered in the system when the Plot2 parameter described below exceeds the Alarm Level, which has a nominal value of 20. Low values of Alarm Level mean that the system is fast to react to possible flames in the picture, but is susceptible to false alarm events. High values of Alarm Level mean that the system is insensitive to false alarm events, but is slow to react to possible flames in the picture.

The Plot1 and Plot2 parameters are calculated in the following manner by scanning horizontally across the "awareness map". As the scan is performed from left to right across each horizontal line of the "awareness map" the value of adjacent pixels are compared and a value is entered into an edge contour that starts at a value of zero. If adjacent pixels are equal to one another than nothing is added to the edge counter. If adjacent pixels are not equal to one another then 1 is added to the edge counter. At the same time, the total number of pixels with binary value 1 is counted and added into a pixel counter. This operation is performed for each of the 480 lines of the image (from top to bottom) and the values for the edge counter and the pixel counter are summed. At the end of this procedure two integers have been calculated. These are:

Edgesum=Sum of horizontal edge transitions in awareness map as described.

Pixelsum=Total number of pixel with binary value 1 in the awareness map as described above.

In parallel with this the coordinates of the pixels with binary value 1 are noted. A region of interest is defined by noting the following quantities:

x1=Minimum x coordinate
x2=Maximum x coordinate
y1=Minimum y coordinate
y2=Maximum y coordinate The area of the region of interest is defined as:

$$ROIarea=(x2-x1)\times(y2-y1)$$

The Plot1 parameter is calculated as follows:

$$Plot1=(Pixelsum=Edgesum)/ROIarea$$

This is a measure of the sparseness of the flicker in the image, and can be used to discriminate between treelike objects and more densely packed flame like objects. If Plot1 is less than zero then the image is sparse and if Plot1 is greater than zero the image is dense.

The Plot2 parameter is calculated as follows:

$$Plot2=Pixelsum/ROIarea$$

In step 6, prior to performing the final flame decision, the "plot" parameters described above are smoothed using a user defined dimenisonless time constant k3 with a time constant of 8.0 seconds. k3 is calculated in the following manner:

$$k3=8.0\ s/(\text{time in seconds between successive frames})$$

k3 is applied between successive values of Plot1 and Plot2 obtained from successive video images using the same filtering techniques as used by k1 and k2 described in a previous part of the document. This reduces the noise level in the plotted parameters and reduces the false alarm rate. The decision whether a flame is occurring within the video image has two operator selectable modes: normal mode and tree filter mode. When it has been determined that a flame is occurring in the picture, an alarm is set off to indicate the presence of a flame threat.

Normal flame decision mode is employed when no treelike objects are in the picture. In this mode, Plot1 is ignored. Here, an alarm is triggered when the Plot2 parameter is greater than the user defined Plot0 parameter.

In tree filter mode, it was found that the flicker movement detected by the algorithm was sparsely distributed for a treelike object and densely distributed for a fire. A positive value of Plot1 indicates a densely packed arrangement of flickering pixels i.e. a flame, and a negative value of Plot1 indicates a sparsely packed arrangement of flickering pixels i.e. leaves on a tree moving in the wind. The alarm for a flame with the tree filter on only occurs when Plot2 is greater than the Plot0 AND Plot1 is greater than zero.

The inventors have found that inclusion of the tree filter increases the selectivity of the system, but also increases the amount of time required to reach a decision on whether a flame is present in the picture.

ADDITIONAL EMBODIMENTS

The algorithm described above has been optimised by empirical methods and the constants determining the function of the algorithm may be chosen to achieve optimum results within the scene environment.

Further it can be seen that systems comprising colour video images, or with differing pixel resolutions may be processed by such algorithms. Extensions to the algorithms above will be obvious to those experienced in the art.

The techniques and man-machine interface described in the applicants smoke detection system described in PCT application GB99/03459 can be applied to the flame detection system described above.

What is claimed is:

1. A method for detecting a flame, said method comprising:

receiving a stream of individual digital images;

filtering each of said individual digital images; and producing a movement band image, said movement band image displaying changes in said stream of individual digital images within a predetermined frequency band after said step of filtering is performed on a plurality of said individual digital images, and wherein said predetermined frequency band identifies at least one characteristic of the flame, wherein said step of filtering comprises:

creating a first generated image and a second generated image from each of said individual digital images;

applying a filter having a first frequency to said first generated image;

applying a filter having a second frequency to said second generated image, wherein said first frequency and said second frequency are different, and said first frequency and said second frequency are comprised in said predetermined frequency band; and combining said first filtered generated image with said second filtered generated image to produce said movement band image.

2. A method for detecting a flame, said method comprising:

receiving a stream of individual digital images;

filtering each of said individual digital images; and producing a movement band image, said movement band image displaying changes in said stream of individual digital images within a predetermined frequency band after said step of filtering is performed on a plurality of said individual digital images, and wherein said predetermined frequency band identifies at least one characteristic of the flame, further comprising applying a threshold value to each pixel in each of said individual images to develop a threshold map, wherein said movement band image comprises a predetermined number of pixels, and wherein said threshold map is used to determine a relative value of each pixel with respect to said threshold value.

3. The method of claim 2, further comprising generating a binary image from said threshold map.

4. The method of claim 3, further comprising assigning an awareness level value to each pixel of said threshold map, wherein said awareness level value increases in response to changes in said pixel values in successive individual digital images which intersect said threshold value, and wherein said awareness level value represents an indication of the flame.

5. The method of claim 3, further comprising detecting at least one characteristic of the flame by obtaining a sparseness parameter and an edge occurrence parameter in said binary image.

6. The method of claim 5, further comprising detecting an area of at least one characteristic of the flame in said binary image from said threshold map by identifying changes in a pixel value in successive digital images in said stream of digital images which intersect said threshold value.

7. The method of claim 6, further comprising calculating a sparseness parameter and an edge parameter by analyzing pixel values in said binary image.

8. The method of claim 7, further comprising determining whether to sound an alarm after performing said calculating step.

9. The method of claim 7, further comprising differentiating whether said area of at least one characteristic comprises an image of one of moving trees and a flame.

10. The method of claim 2, further comprising generating a binary awareness map, said binary awareness map representing a subset of said threshold map and indicating a change to a pixel vale in said threshold map that is greater than said threshold value when pixel values in successive images in said stream of images intersect said threshold value.

11. The method of claim 1, further comprising classifying changes in successive individual images in said stream of images to represent one of a flicker and a non-flicker.

12. The method of claim 1, wherein said stream of digital images originates from one of live and recorded video.

13. A method for processing a sequence of digital video images to detect a flame, said method comprising:

monitoring a stream of images and creating a new image having a predetermined number of pixels;

developing a threshold map, said threshold map generated by applying a threshold value to each pixel of each image in said stream of images wherein said threshold map determines a relative value of each pixel with respect to said threshold value; and generating an awareness map from said threshold map to detect a sequence of images of flames, wherein said awareness map indicates at least one change in values of pixels in successive images in said stream of images that cross said threshold value, further comprising allocating an awareness level value to each pixel of each image in said stream of images, wherein said awareness level value increases when said at least one change is detected, and analyzing a plurality of said awareness level values to generate a fire detection indicator.

14. The method of claim 13, further comprising classifying changes in successive individual images in said stream of images to represent one of a flicker and a non-flicker.

15. The method of claim 13, wherein said stream of digital images originates from one of live and recorded video.

* * * * *